United States Patent [19]

Lattmann et al.

[11] 4,171,262

[45] Oct. 16, 1979

[54] APPARATUS FOR ELIMINATING METALLIC CONTAMINATIONS FROM A FIBRE TRANSPORTING DUCT IN SPINNING PREPARATION

[75] Inventors: Werner Lattmann; Rudolf Wildbolz, both of Winterthur, Switzerland

[73] Assignee: Rieter Machine Works, Ltd., Winterthur, Switzerland

[21] Appl. No.: 911,062

[22] Filed: May 31, 1978

[30] Foreign Application Priority Data

Jun. 9, 1977 [CH] Switzerland ..... 7094/77

[51] Int. Cl.[2] ..... B07C 5/00; B07C 5/344

[52] U.S. Cl. ..... 209/555; 209/570; 209/906; 209/657; 209/933

[58] Field of Search ..... 209/570, 567, 906, 657, 209/933, 555; 302/28

[56] References Cited

U.S. PATENT DOCUMENTS

| | | | |
|---|---|---|---|
| 2,444,751 | 7/1948 | Scott | 209/570 X |
| 3,096,882 | 7/1963 | Tyler | 209/906 X |
| 4,085,977 | 4/1978 | Varga | 302/28 |
| 4,116,435 | 9/1978 | Sines | 209/657 X |

*Primary Examiner*—Allen N. Knowles

*Attorney, Agent, or Firm*—Werner W. Kleeman

[57] ABSTRACT

An apparatus for eliminating metallic contaminations from a fibre transporting duct in spinning preparation, wherein an air stream transports fibre flocks through the duct. At a branching point of the fibre transporting duct leading to a waste duct there is pivotably arranged deflecting means operatively connected with and activated by a drive mechanism. The deflecting means are activated in response to the passage of a metallic object or other metallic contaminations through a section of the fibre transporting duct surrounded by a metal detector arranged upstream of the branching point, by means of a control device connected with a power source and the drive mechanism. Within a short time the deflecting means can be shifted from an idle or ineffectual position, where the transporting duct is open and the waste duct is maintained closed, into a working position, in which the transporting duct is closed and the waste duct is maintained open.

12 Claims, 1 Drawing Figure

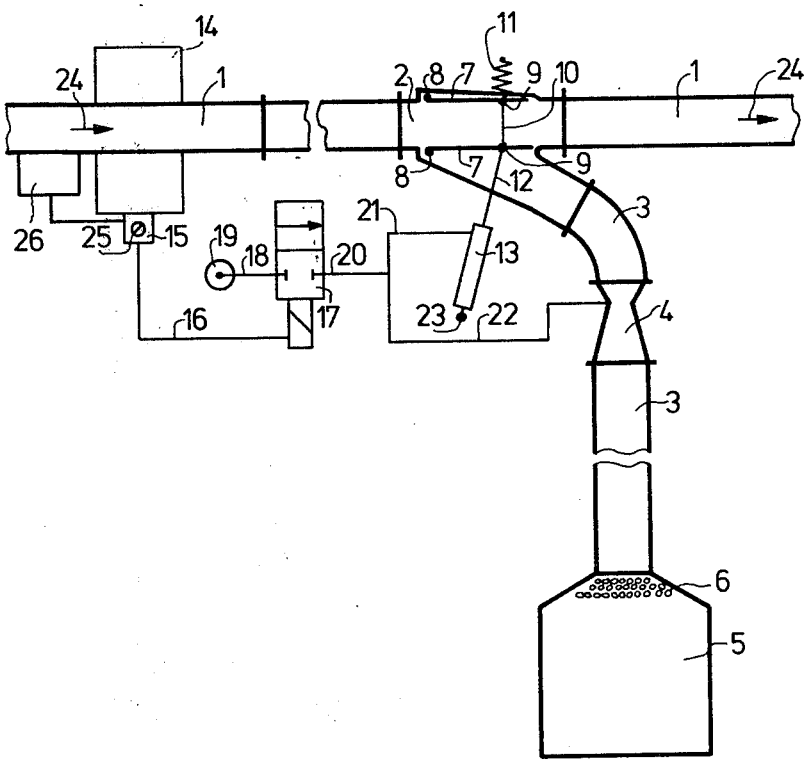
14
11
24
1
2
8
7
9
10
1
24
8
7
12
9
3
26
25
15
19
18
20
21
13
16
17
23
22
4
3
6
5

APPARATUS FOR ELIMINATING METALLIC CONTAMINATIONS FROM A FIBRE TRANSPORTING DUCT IN SPINNING PREPARATION

BACKGROUND OF THE INVENTION

The present invention relates to a new and improved apparatus for eliminating metallic contaminations from a fibre transporting duct in spinning preparation, within which duct fibre flocks are transported by an air stream.

Fibre bales very often contain metallic objects which are pressed into such bales in the form of contaminations which are undesirable during spinning preparation. In modern spinning plants where bale opening is effected mechanically and fibre transport to the individual opening and cleaning machines is effected pneumatically within fibre transporting ducts, the detection and elimination of such metallic objects proves extremely difficult. Furthermore, waste fibres, which are re-processed, also often contain metallic contaminations. Additionally, metallic objects can enter the fibre transporting stream due to personnel negligence.

The mentioned metallic objects or the like present a great danger for the plant inasmuch as they can generate sparks and thus can cause fires. Also they can damage the transporting fans or the subsequently arranged processing machines. Therefore, attempts have been made to eliminate metallic objects from the fibre transporting ducts.

According to a device which has become known in practise two magnetic plates are arranged in a bend of the duct. These magnetic plates are offset with respect to one another in such a manner that metallic objects not caught by the first plate impact the second plate and adhere thereto. The magnetic plates can be pivotably opened for eliminating the metallic objects. This prior art device, however, presents serious disadvantages. Thus, only magnetic metal objects are held back while all other metallic objects such as, for instance, aluminum, are not eliminated. Furthermore, it can happen that magnetic metal objects can be transported between the plates without being caught.

SUMMARY OF THE INVENTION

Hence, it is a primary object of the present invention to avoid these disadvantages and to devise an apparatus for eliminating all types of metals down to the smallest particle size.

Another and more specific object of the present invention aims at providing apparatus for effectively eliminating metallic contaminations from a fibre transporting duct in spinning preparation through the use of relatively simple, highly effective and operationally reliable means, requiring a minimum of maintenance and servicing and not readily subject to breakdown or malfunction.

Yet a further significant object of the present invention aims at providing apparatus for eliminating metallic contaminations from a fibre transporting duct incorporating structure highly responsive to the presence of any metallic contaminations within the fibre transporting duct, which when activated by-passes the metallic contaminations along with the fibre flocks containing the same into a waste container or the like, thereby safeguarding against possible damage to textile equipment arrangement downstream of the fibre transporting duct.

These objects and others which will become apparent as the description proceeds are achieved by means of the inventive apparatus for eliminating metallic contaminations from a fibre transporting duct in spinning preparation, through which duct there are transported fibre flocks by means of an air stream, characterized by the features that at a branching point of the transporting duct leading to a waste duct there is pivotably arranged deflecting means operatively connected with and activated by a drive mechanism. The deflecting means are activated in response to the passage of a metallic object or other metallic contaminations through a section of the fibre transporting duct surrounded by a metal detector arranged upstream of the branching point, by means of a control device connected with a power source and the drive mechanism. Within a short time the deflecting means can be shifted from an idle or ineffectual position, in which the transporting duct is open and the waste duct is maintained closed, into a working position, in which the transporting duct is closed and the waste duct is maintained open.

According to an advantageous embodiment of the inventive apparatus a double flap can be provided as the deflecting means and an electro-pneumatic valve can be provided as the control device. The control device can be connected with a source of compressed air serving as the power source and with a pneumatic cylinder serving as the drive mechanism. The distance between the metal detector and the transporting duct branching point can be chosen of such length that the transporting time required for transporting the fibre flocks from the metal detector to the transporting duct branching point exceeds the switching time of the double flap from its idle position to its working position. At a fibre flock transporting speed of 10 m/sec the distance from the metal detector to the branching can be in the range of 3 m at the best. It can prove advantageous to provide an air permeable waste collecting recipient at the end of the waste duct.

Some of the more notable advantages attained by the invention is that it is possible to positively eliminate all types of metallic contaminations from the fibre transporting duct, even down to the smallest size metallic particles or contaminants. Textile equipment located downstream of the fibre transporting duct is therefore effectively safeguarded against damage. Further, the system can be easily adapted to different transporting speeds of the fibre flocks moving through the fibre transporting duct without impairing its detection capability. With the use of extremely simple means it is possible to effectively by-pass the metallic contaminants into a waste receptacle or the like following detection thereof upstream of a branching point or branching portion of the fibre transporting duct. Equally, any potential fire hazards which might be caused by the metallic contaminations can be detected early enough to safeguard thereagainst, and even if the metallic contaminations cause burning of the fibre flocks the same can be eliminated from the fibre transporting duct, again safeguarding any downstream arranged textile equipment from becoming damaged.

BRIEF DESCRIPTION OF THE DRAWING

The invention will be described in greater detail hereinafter with reference to an exemplary embodiment illustrated in the single FIGURE of the drawing. This figure schematically shows a fibre transporting duct equipped with the metal eliminating apparatus constructed according to the teachings of the present invention.

DETAILED DESCRIPTION OF THE PREFERRED EMBODIMENTS

Describing now the drawing, a fibre transporting duct 1 contains a branching element or branch portion 2 at a branching point of the duct 1 and which is connected with the continuation of such duct 1 and with a waste duct 3. The waste duct 3 leads via an air-mover 4 to an air pervious waste recipient or container 5 which is provided with small openings 6 at least in its upper portion. The waste recipient 5 may be formed of perforated sheet metal, by way of example. In the branching element 2, the cross-section of which preferably is rectangular, there is arranged a double flap defining deflecting means and which contains two plates 7 which are essentially parallel to the upper and lower duct wall. The double flap composed of the two plates 7 is pivotable about hinges 8 or equivalent pivot means. These plates 7 are interconnected by means of a rod 10 which, in turn, is supported on hinges 9. At the upper hinge 9 there is provided a tension spring 11, whereas the lower hinge 9 is connected via a piston rod 12 with a fluid operated, for instance, compressed air cylinder 13 constituting a drive mechanism.

Upstream of the branching element 2 a metal detector 14 is arranged on the duct 1. A control part 15 of the metal detector 14 is connected via a circuit 16 with an electro-pneumatic valve 17 constituting a control device. The valve 17, which is connected via a duct 18 with a suitable source of compressed air 19 defining a power source, is connected via a duct 20 and a branching duct or branch line 21 with the compressed air cylinder 13 and by means of a branching duct or branch line 22 is connected with the air-mover 4. The compressed air cylinder 13 is pivotably hinged on a hinge 23.

During operation an air stream which transports fibre flocks is sucked through the duct 1 in the direction of the arrows 24, for instance, by means of a fan which has not been particularly shown.

The extension (not shown) of the duct 1 can lead to any spinning preparatory machine. In the normal operating state, the spring 11 holds the plates 7 of the double flap in such a manner that the access to the waste duct 3 is kept closed and the fibres are transported without disturbance through the duct 1. The flow connection between the compressed air ducts 18 and 20 is maintained interrupted by the electro-pneumatic control valve 17.

Now, if a metal object passes through the duct section surrounded by the metal detector 14, then a current is induced in the metal detector 14. The control part or device 15 simultaneously transmits an electrical signal via the circuit 16 to the electro-pneumatic control valve 17. This control valve 17 immediately switches and provides a flow connection between the compressed air ducts 18 and 20 in such a manner that compressed air passes through the branching duct 22 to the air-mover 4 and by means of the branching duct 21 into the compressed air cylinder 13. The piston rod 12 now is pulled into the cylinder 13, and thus, pivots the double flap-plates 7 against the force of the tension spring 11 until the duct 1 is sealed or blocked by the upper plate 7 and the waste duct 3 is freed or uncovered by the lower plate 7.

Since the compressed air flows axially in the direction towards the waste recipient 5 into the air-mover 4, a suction action is generated, owing to the injector action, within the connecting member or portion of the waste duct 3 connected to the branching element 2. Consequently, the fibre and air mixture is sucked from the fibre transporting duct 1 into the waste duct 3 and is transported into the waste recipient or container 5. At this location the transporting air escapes via the openings 6, whereas the entrained fibre flocks are deposited. As the time lag between the detection of a metal particle and the switching of the double flap structure is shorter than the time required for transporting the metal particle to the region of the branching element 2, the metal particle together with the fibre flocks are guided via the waste duct 3 into the waste recipient or container 5.

After there has elapsed a time lag, which can be preset at a key 25 or equivlaent structure of the control part or device 15, and during which time lag the metal particle has been positively eliminated into the waste duct 3, the control device or part 15 transmits a further electric signal which immediately causes interruption of the previously established flow connection with the source of compressed air 19 by the valve 17. The tension spring 11 now pulls back the plates 7 of the double flap into their initial position in such a manner that the waste duct 3 again is sealed and the transporting duct 1 again is open. The air displaced out of the compressed air cylinder 13 during this process escapes via the branch lines or branching ducts 21 and 22 into the air-mover 4. In the fibre transporting duct 1 there now again prevails normal operation until a further metal particle transported through the duct 1 again activates the sequence of operations described above.

Inductively functioning metal detectors are commercially available. By using such devices there can be detected the smallest metal particles down to a linear dimension of 0.25 mm. By incorporating a device of this type into the apparatus described above, all metal particles constituting a danger for any downstream arranged machine are detected and eliminated. In order to ensure reliable functioning of the metal detector, the duct section on which the detector is mounted should be fabricated from a non-metallic material, for instance a plastic material.

For reliable functioning of the described apparatus, the metal detector 14 should be mounted sufficiently far upstream of the branching element 2. If this condition is not fulfilled, it could happen that the metal particle already has moved past the branching element 2 before the double flap composed of the plates 7 has been switched. Experiments have proven that the time lag between the detection of a metal particle and the complete opening of the access to the waste duct 3 by the double flap is in the order of 0.2 seconds. At a transporting speed of the air and fibre mixture in the transporting duct 1 in the order of 10 m/sec. the distance between the metal detector 14 and the branching element 2 thus should be chosen to be greater than 2 meters. If there is provided a suitable safety margin then a distance of 3 meters has been found to be favourable.

Furthermore, since larger metal particles tend to move through the fibre transporting duct 1 at lower speeds than the air and fibre mixture, the waste duct 3 also should not be again sealed or blocked too early. Otherwise it could happen that the metal particle passes the branching element 2 only after the waste duct 3 has again been sealed, and thus, is carried on through the extension of the transporting duct 1. Experiments have proven that at a speed of 10 m/sec. of the fibre and air mixture in the transporting duct 1 and if the distance of the metal detector 14 from the branching element 2 is 3 meters, then keeping the waste duct 3 open during 1 second is sufficient for eliminating any metal particle with certitude. This time lag can be pre-set in the control device or part 15 of the metal detector 14, and it can be of course altered if other transporting speeds are chosen to prevail in the transporting duct 1.

If the very unlikely case should occur that two metal particles pass through the transporting duct 1 at a very short interval, the metal detector 14 transmits a second signal for maintaining open the waste duct 3 during such time as the second metal particle passes the metal detector. The waste duct 3, which is already opened in this case, remains open until the pre-set time lag has elapsed after the second metal particle has passed the metal detector 14 such that both metal particles are eliminated.

Incorporation of an air-mover 4 in the waste duct 3 is required as the fibre flocks are sucked through the transporting duct 1 under the influence of a vacuum. If the transporting duct 1 is sealed off in such a manner that there no longer prevails any suction action, then the air-mover 4, which works according to the injector principle, generates the suction action required in the waste duct 3. Further transport of the fibre flocks downstream of the air-mover 4 into the waste recipient 5 is effected under above-atmospheric pressure as the compressed air enters in axial direction over the circumference of the air-mover 4. Air-movers or equivalent structure also are available commercially. Instead of a waste recipient or container 5 made from perforated sheet metal there also could be used a waste bag or sack made from textile fabrics as the waste recipient or container 5. Sufficient bag fabric porosity or air permeability, however, is required, so that the transporting air can escape and the fibre flocks containing the metal particle are separated in the bag.

Additionally, a fire detector 26 arranged upstream of the metal detector 14 can be connected in parallel with the control part 15 of the metal detector 14 in such a manner that if smoke particles are detected by the fire detector 26, then the "burning fibre flock stream" also can be switched or bypassed to the waste recipient or container 5, in which case the resetting of the switching or control device is interrupted. In this manner the expensive machine connected to the transporting duct can be protected against fire damage.

While there are shown and described present preferred embodiments of the invention, it is to be distinctly understood that the invention is not limited thereto, but may be otherwise variously embodied and practised within the scope of the following claims. Accordingly,

What we claim is:

1. An apparatus for eliminating metallic contaminations from a fibre transporting duct in spinning preparation, wherein an air stream transports fibre flocks through the fibre transporting duct, comprising:

a fibre transporting duct;

a waste duct operatively connected with the fibre transporting duct at a branching point thereof;

deflecting means for the fibre flocks;

means for pivotably mounting said deflecting means at the branching point of the fibre transporting duct;

a drive mechanism for activating said deflecting means;

a metal detector arranged upstream of the branching point with respect to the direction of movement of the fibre flocks through the fibre transporting duct and surrounding at least a portion of the fibre transporting duct;

means defining a power source for operating said drive mechanism;

control means for operatively communicating said power source with said drive mechanism for selectively activating said deflecting means;

said metal detector being operatively connected with said control means for activating said deflecting means in response to the passage of a metallic object through said portion of the fibre transporting duct at least partially surrounded by said metal detector, in order to shift within a short time the deflecting means from an idle position, where the fibre transporting duct is open and the waste duct is maintained closed, into a working position, in which the fibre transporting duct is closed and the waste duct is maintained open.

2. The apparatus according to claim 1, wherein:

said deflecting means comprises a double flap structure;

said control means comprises an electro-pneumatic valve;

said power source comprises a source of compressed air with which there is connected said electro-pneumatic valve; and said drive mechanism comprises a pneumatic cylinder operatively connected by means of said electro-pneumatic valve with said source of compressed air.

3. The apparatus according to claim 2, wherein:

said metal detector incorporates a control part for activating switching of the double flap structure by opening the electro-pneumatic valve; and means for setting a time lag to retain the electro-pneumatic valve in an open position for a predetermined period of time.

4. The apparatus according to claim 2, wherein:

the distance between the metal detector and the branching point of the fibre transporting duct is chosen sufficiently large such that the time required for transporting the fibre flocks from the region of the metal detector to the branching point of the fibre transporting duct exceeds the time required for shifting the double flap structure from its idle position into its working position.

5. The apparatus according to claim 4, wherein:

the distance between the metal detector and the branching point of the fibre transporting duct is in the order of about 3 meters when there is employed a fibre transporting speed of approximately 10 m/sec.

6. The apparatus according to claim 1, further including:

an air permeable waste recipient means arranged at an end of said waste duct.

7. The apparatus according to claim 6, wherein:

said air permeable waste recipient means is formed of perforated sheet metal.

8. The apparatus according to claim 6, wherein:

said air permeable waste recipient means comprises a bag formed of a textile fabric material.

9. The apparatus according to claim 1, further including:

means for creating a vacuum action for sucking the fibre flocks through the fibre transporting duct.

10. The apparatus according to claim 9, wherein:

the means for creating a vacuum action comprises an air-mover; and branch duct means for operatively connecting said air-mover with said control means.

11. The apparatus according to claim 10, wherein:

said control means comprises an electro-pneumatic valve.

12. The apparatus according to claim 1, further including:

fire detector means connected in parallel with said metal detector and mounted at said fibre transporting duct upstream of said metal detector.

* * * * *